US006684636B2

(12) United States Patent
Smith

(10) Patent No.: US 6,684,636 B2
(45) Date of Patent: Feb. 3, 2004

(54) ELECTRO-HYDRAULIC PUMP CONTROL SYSTEM

(75) Inventor: David P. Smith, Joliet, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/984,055

(22) Filed: Oct. 26, 2001

(65) Prior Publication Data

US 2003/0106314 A1 Jun. 12, 2003

(51) Int. Cl.[7] ..... F16D 31/02

(52) U.S. Cl. ..... 60/449; 60/450; 60/452; 417/212

(58) Field of Search ..... 60/449, 452, 327, 60/368; 417/212, 213, 222.1

(56) References Cited

U.S. PATENT DOCUMENTS

| | | | | |
|---|---|---|---|---|
| 3,665,814 | A | | 5/1972 | Ankeny |
| 3,976,098 | A | | 8/1976 | Raymond |
| 4,139,987 | A | | 2/1979 | Budzich |
| 4,399,653 | A | | 8/1983 | Pylat, Jr. |
| 4,474,104 | A | | 10/1984 | Creffield |
| 4,510,750 | A | | 4/1985 | Izumi et al. |
| 4,561,250 | A | | 12/1985 | Aoyagi et al. |
| 4,809,504 | A | | 3/1989 | Izumi et al. |
| 4,967,557 | A | * | 11/1990 | Izumi et al. ..... 60/452 X |
| 5,058,383 | A | | 10/1991 | Tsunemi et al. |
| H1191 | H | | 6/1993 | Hutchison et al. |
| 5,266,756 | A | | 11/1993 | Hatano |
| 5,295,795 | A | * | 3/1994 | Yasuda et al. ..... 417/213 |
| 5,435,131 | A | | 7/1995 | Hausman et al. |
| 5,447,027 | A | * | 9/1995 | Ishikawa et al. ..... 60/452 X |
| 5,527,156 | A | | 6/1996 | Song |
| 5,554,007 | A | | 9/1996 | Watts |
| 5,564,905 | A | | 10/1996 | Manring |
| 5,588,805 | A | | 12/1996 | Geringer |
| 5,666,806 | A | | 9/1997 | Dietz |
| 5,865,602 | A | | 2/1999 | Nozari |
| 5,876,185 | A | | 3/1999 | Schimpf et al. |
| 5,944,492 | A | | 8/1999 | Konishi et al. |
| 5,960,695 | A | | 10/1999 | Aardema et al. |
| 6,048,177 | A | * | 4/2000 | Erkkilae et al. ..... 417/222.1 |
| 6,131,391 | A | | 10/2000 | Poorman |
| 6,179,570 | B1 | | 1/2001 | Smith |
| 6,282,892 | B1 | * | 9/2001 | Arai ..... 60/452 X |
| 6,374,722 | B1 | | 4/2002 | Du et al. |
| 6,375,433 | B1 | | 4/2002 | Du et al. |
| 6,468,046 | B1 | | 10/2002 | Du et al. |
| 2002/0176784 | A1 | | 11/2002 | Du |

* cited by examiner

*Primary Examiner*—Edward K. Look
*Assistant Examiner*—Igor Kershteyn
(74) *Attorney, Agent, or Firm*—Finnegan, Henderson, Farabow, Garrett & Dunner; Steve M Hanley

(57) ABSTRACT

A method is provided for controlling displacement of a variable displacement pump coupled to a load. The method includes determining an electrical signal to be applied to a proportional solenoid for a desired pump displacement based on known pump characteristics. The electrical signal is provided to the proportional solenoid. The displacement of the variable displacement pump is controlled based on the electrical signal to the proportional solenoid.

13 Claims, 8 Drawing Sheets

ELECTRO-HYDRAULIC PUMP CONTROL SYSTEM

TECHNICAL FIELD

This invention relates to an electro-hydraulic pump control system for controlling displacement of a pump. More particularly, the invention is directed to a method and system for electro-hydraulic pump control that utilizes pump characteristics determined from an operation of the pump.

BACKGROUND

A pump having a variable displacement capability is well known in the industry to drive an implement or a hydrostatic motor. In an open-loop hydraulic system, a variable displacement pump is used to drive an implement, such as a cylinder or a hydraulic motor, and the fluid pressure from the pump to the implement is controlled by varying the displacement of the variable displacement pump. In a closed-loop hydrostatic system, similarly, a variable displacement pump is used to drive a hydrostatic motor in the forward or reverse direction, and the speed of the hydrostatic motor is controlled by varying the displacement of the pump.

A variable displacement pump generally includes a drive shaft, a rotatable cylinder barrel having multiple piston bores, and pistons held against a tiltable swashplate biased by a centering spring. When the swashplate is tilted relative to the longitudinal axis of the drive shaft, the pistons reciprocate within the piston bores to produce a pumping action. Each piston bore is subject to intake and discharge pressures during each revolution of the cylinder barrel. As the piston bores sweep pass the top and bottom center positions, a swivel force is generated on the swashplate as a result of the reciprocating pistons and pressure carryover within the piston bores. Some hydrostatic pumps have eliminated the actuator and/or cut-off valves by controlling swivel forces and actuator pressure. In order to accurately control the pump displacement, however, it may be necessary to provide a closed logic on the pump displacement and/or pressure, which increases manufacturing cost and reduces reliability.

In a system to control the pump displacement, a pump control signal is often directed through a variable orifice and a fixed orifice to an actuator to change the displacement of the variable displacement pump. The variable orifice is often controlled by a spool valve that is movable in response to a remote signal. In the past, the arrangement for controlling the displacement of a pump required a pressure cut-off, torque limiters, relief valves, or other components. These components increase the size of the arrangement and the manufacturing cost.

For example, U.S. Pat. No. 6,179,570 discloses a variable pump control for a hydraulic fan drive. The pump control includes a load margin valve arrangement, a pressure cutoff valve, and a proportional solenoid valve arrangement. The load margin valve arrangement has a valve that can be moved in response to pressurized fluid from the pump. The pressure cutoff valve also has a valve that can be moved in response to pressurized fluid from the pump. The proportional solenoid valve arrangement has a solenoid and a valve and can be actuated to control fluid flow through the valve by an electrical signal to the solenoid. The pump control, therefore, requires multiple valves.

Therefore, what is needed is a simplified pump control system involving lower manufacturing cost which overcomes one or more of the problems as set forth above.

SUMMARY OF THE INVENTION

In one aspect of the invention, a method is provided for controlling displacement of a variable displacement pump coupled to a load. The method includes determining an electrical signal to be applied to a proportional solenoid for a desired pump displacement based on known pump characteristics. The electrical signal is provided to a proportional solenoid. The displacement of the variable displacement pump is controlled based on the electrical signal to the proportional solenoid.

In another embodiment, a method is provided for controlling displacement of a variable displacement pump coupled to a load. The method includes applying an electrical signal of varying amplitude to a proportional solenoid during operation of the variable displacement pump. Displacement of the variable displacement pump is evaluated for different amplitudes of the electrical signal to create reference points for the electrical signal and the pump displacement. The electrical signal to be applied to the proportional solenoid for a desired pump displacement is determined by interpolation.

In yet another embodiment, a pump control system is provided for controlling displacement of a variable displacement pump that receives fluid from a reservoir and is coupled to a load. The pump has minimum and maximum displacement positions and a pressure outlet port. The pump control system includes a displacement changing mechanism and a proportional solenoid valve arrangement. The proportional solenoid valve arrangement is connected to the pressure outlet port of the variable displacement pump and is operative to control fluid flow to and from the displacement changing mechanism. The proportional solenoid valve arrangement includes a three-way proportional valve movable between first and second positions. The first position allows the displacement changing mechanism to be in fluid communication with the reservoir and to be blocked from the pressure outlet port of the variable displacement pump. The second position allows the displacement changing mechanism to be in fluid communication with the pressure outlet port of the variable displacement pump. The proportional solenoid valve arrangement also includes a proportional solenoid operative to provide a variable force to move the proportional valve. A captured spring assembly is disposed between the proportional solenoid and the proportional valve. The captured spring assembly defines minimum and maximum control pressure settings.

In yet another embodiment, a fluid control system is provided. The fluid control system includes a variable displacement pump in communication with a pump control unit, a fluid displacement changing mechanism, and a valve arrangement fluidly connected to the variable displacement pump and operative to fluidly communicate with the displacement changing mechanism. The system also includes a solenoid configured to operate the valve arrangement in response to a control signal input to the solenoid. A range of operation of the variable displacement pump is represented by the control signal based on predetermined system characteristics. The pump control unit is operative to infinitely update the control signal in response to the controller and at least one sensor sampling an operation condition.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments of the invention and together with the description, serve to explain the principles of the invention.

DETAILED DESCRIPTION

Figure 1A:
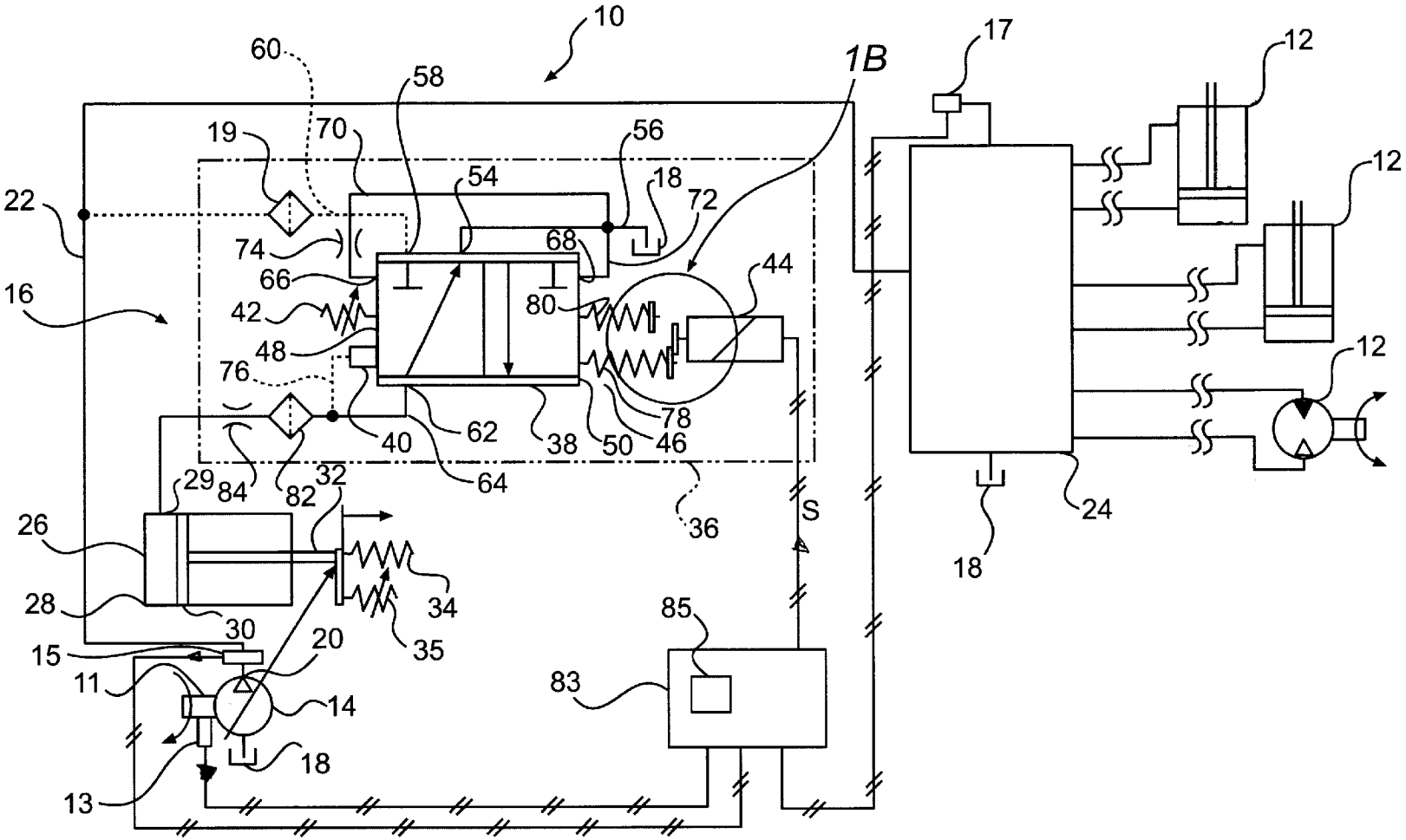
FIG. 1A illustrates a schematic and diagrammatic representation of an electro-hydraulic pump control system according to one embodiment of the present invention.

Reference will now be made in detail to the present preferred embodiments of the invention, examples of which are illustrated in the accompanying drawings. Wherever possible, the same reference numbers will be used throughout the drawings to refer to the same or like parts.

FIG. 1 illustrates one embodiment of the pump control arrangement for controlling displacement of a variable displacement pump coupled to a load 12, such as implement devices including cylinder pistons, hydraulic motors, or for example, other implement devices apparent to one skilled in the art. Open loop system 10 for driving implement devices 12 includes a variable displacement pump 14 and a pump control system 16 for controlling displacement of the pump 14. The pump 14 is fluidly connected to the implement devices 12 via a supply conduit 22 and an implement control valve 24 for driving the implement devices 12. The pump 14 is driven by a motor, such as an engine, via a drive train 11, and receives fluid from a reservoir 18. The pump 14 has a pressure outlet port 20 connected to the supply conduit 22, and can vary its displacement between minimum and maximum displacement positions. By changing the displacement, the pump 14 can provide necessary fluid pressure to the implement devices 12.

In an exemplary embodiment, the pump 14 also has a pump speed sensor 13 that can measure the speed of the pump 14. The speed of the pump 14 can be measured by monitoring the drive train 11 or by any other method known to those having ordinary skill in the art. In addition, the pump 14 may have a pump pressure sensor 15 for measuring fluid pressure at the outlet port 20. Similarly, the implement 12 may have a load pressure sensor 17 that can monitor fluid pressure at the implement 12.

The displacement of the pump 14 is controlled by a displacement changing mechanism 26*a*. In one exemplary embodiment shown in FIG. 1A, the displacement changing mechanism 26*a* includes a cylinder 28 having an inlet port 29 and a piston 30 connected to an actuating rod 32. The piston 30 is disposed within the cylinder 28, and the actuating rod 32 is coupled to the pump 14. The displacement changing mechanism 26*a* has a spring 34 to bias the piston 30 and the actuating rod 32 to the minimum displacement position of the pump 14. The piston 30 and the actuating rod 32 are movable against the spring bias towards the maximum displacement position in response to pressure applied to the actuator assembly 26*a* through the inlet port 29. A spring 35 with variable biasing force may be utilized so that the biasing force can be readily calibrated.

The open-loop system 10 also includes a proportional solenoid valve arrangement 36 connected to the pressure outlet port 20 of the variable displacement pump 14 to control the displacement of the pump 14 between its minimum and maximum displacement positions. As shown in FIG. 1A, the proportional solenoid valve arrangement 36 is connected to the pump 14 via the supply conduit 22 and a conduit 60. Preferably, a filter 19 is provided at the conduit 60. The proportional solenoid valve arrangement 36 includes a three-way proportional valve 38, a pressure chamber 40, a spring biasing mechanism 42, and a proportional solenoid 44. The valve arrangement 36 may also include a captured spring assembly 46.

The proportional valve 38 has a valve element therein (not shown in the figure) and first and second ends 48, 50. In an exemplary embodiment, the proportional valve 38 has a first port 54 connected to the reservoir 18 by a conduit 56, a second port 58 connected to the outlet port 20 of the pump 14 by the conduit 60 and a portion of the supply conduit 22, and a third port 62 connected to the displacement changing mechanism 26*a* by a conduit 64. In one embodiment, a filter 82 and an orifice 84 are provided in the conduit 64 between the third port 62 of the proportional valve 38 and the displacement changing mechanism 26*a*. The reservoir 18 connected to the conduit 56 may be the same reservoir that supplies the fluid to the pump 14.

The first and second ends 48, 50 of the proportional valve 38 have fluid vent chambers 66, 68, respectively, connected to the reservoir 18 by conduits 70, 72 and a part of the conduit 56. A control orifice 74 is disposed in the conduit 70. The fluid vent chambers 66, 68 are provided to drain leakage from the valve 38.

The proportional valve 38 has a first position and a second position. In the first position (shown in FIG. 1A), the first port 54 and the third port 62 are in fluid communication, and the proportional valve 38 passes the fluid from the displacement changing mechanism 26*a* to the reservoir 18 via the conduit 64, the third port 62, the first port 54, the conduit 72, and the conduit 56. At the same time, the fluid communication between the displacement changing mechanism 26*a* and the variable displacement pump 14 is blocked. In the second position of the proportional valve 38 (not shown), the second port 58 and the third port 62 are in fluid communication, and the proportional valve 38 passes the fluid from the pump 14 to the displacement changing mechanism 26*a* via the conduit 60, the second port 58, the third port 62, and the conduit 64. Simultaneously, the fluid communication between the displacement changing mechanism 26*a* and the reservoir 18 is blocked. The proportional valve 38 may be moved to positions between the first position and the second position to control fluid flow through the valve.

The proportional solenoid valve arrangement 36 has the spring biasing mechanism 42 disposed at the first end 48. The spring biasing mechanism 42 is operative to bias the proportional valve 38 towards the first position to pass fluid from the displacement changing mechanism 26*a* to the reservoir 18. The spring biasing mechanism 42 may provide a variable biasing force so that it can be calibrated.

The proportional solenoid valve arrangement 36 also includes the pressure chamber 40, which is typically formed by a differential area or a biasing piston, disposed at the first end 48. As shown in FIG. 1A, the pressure chamber 40 is connected to the third port 62 of the proportional valve 38 by a conduit 76 and a part of the conduit 64. In certain embodiments, the effective cross-sectional area of the pressure chamber 40 is less than the cross-sectional area of the valve element in the proportional valve 38.

Additionally, the proportional solenoid valve arrangement 36 includes the proportional solenoid 44 disposed at the second end 50 of the proportional valve 38. In response to receipt of a variable electrical signal "S," the proportional solenoid 44 applies a varying force in opposition to the spring biasing mechanism 42 acting at the first end 48 and moves the proportional valve 38 towards the second position.

The proportional solenoid valve arrangement 36 includes the captured spring assembly 46 disposed at the second end 50 between the proportional solenoid 44 and the housing of the proportional valve 38. In an exemplary embodiment, the captured spring assembly 46 has two springs 78, 80. A gap 79 exists between the end of spring 80 and spring 78.

Figure 1C:
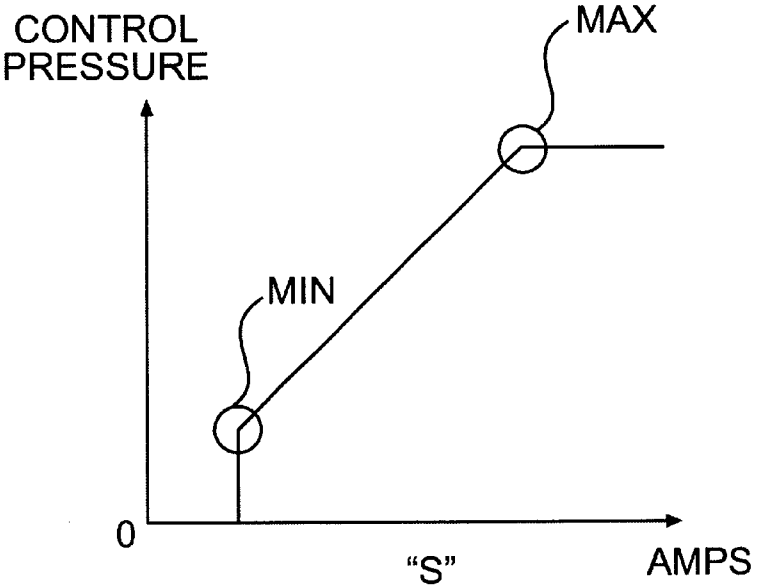
FIG. 1C is a graph illustrating the relationship between a control pressure and an electrical signal "S" applied to the pump control system shown in FIG. 1A.
Figure 1B:
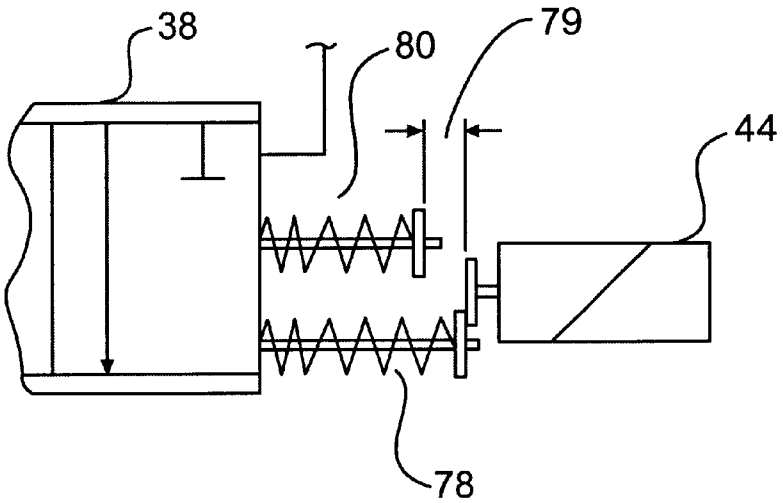
FIG. 1B is an enlarged view of a portion of the electro-hydraulic pump control system of FIG. 1A.

FIG. 1B illustrates a detailed view of the captured spring assembly 46. As shown in FIG. 1B, the two springs 78, 80 are arranged so that the proportional solenoid 44 first contacts the spring 78 and applies force against only the spring 78, and then subsequently contacts the spring 80. The spring 78 is preloaded to define a minimum pressure setting that must be overcome when the solenoid 44 contacts the spring 78 to achieve movement of the proportional valve 38. The minimum setting may be set below the pump's centering spring preload so that the pump does not provide pump discharge pressure at the minimum pressure setting of the control pressure. The spring 80 is preloaded to define a maximum pressure setting when the solenoid 44 contacts both springs 78, 80. The maximum pressure setting is preset to a desired level. Once preset and measured, these known minimum and maximum control limits can be used to interpolate intermediate control pressures.

As shown in FIG. 1A, the proportional solenoid valve arrangement 36 preferably includes a pump control unit 83 having a memory 85. The pump control unit 83 is coupled to the proportional solenoid 44 and provides the electrical signal "S" to the proportional solenoid 44 to produce a desired force to move the proportional valve 38. The pump control unit 83 is also coupled to the pump speed sensor 13, the pump pressure sensor 15, and the load pressure sensor 17 to monitor the pump speed, the outlet pressure of the variable displacement pump 14, and the pressure at the load 12. Based on the monitored values, the pump control unit 83 determines pump characteristics and stores them in the memory 85. Based on the pump characteristics and the desired pump output, the pump control unit 83 sends the electrical signal "S" to the solenoid 44.

FIG. 1C illustrates the relationship between the electrical signal "S" and the control pressure applied to the proportional valve 38 by the proportional solenoid 44 and the springs 78, 80. Two inflection points on this amplitude v. signal/control pressure curve can be located using curve intersection, derivatives, or other known techniques. An interpolation technique can be subsequently performed to find an intermediate point between the two inflection points. FIG. 1C is explained in detail in the following "Industrial Applicability" section.

Figure 2:
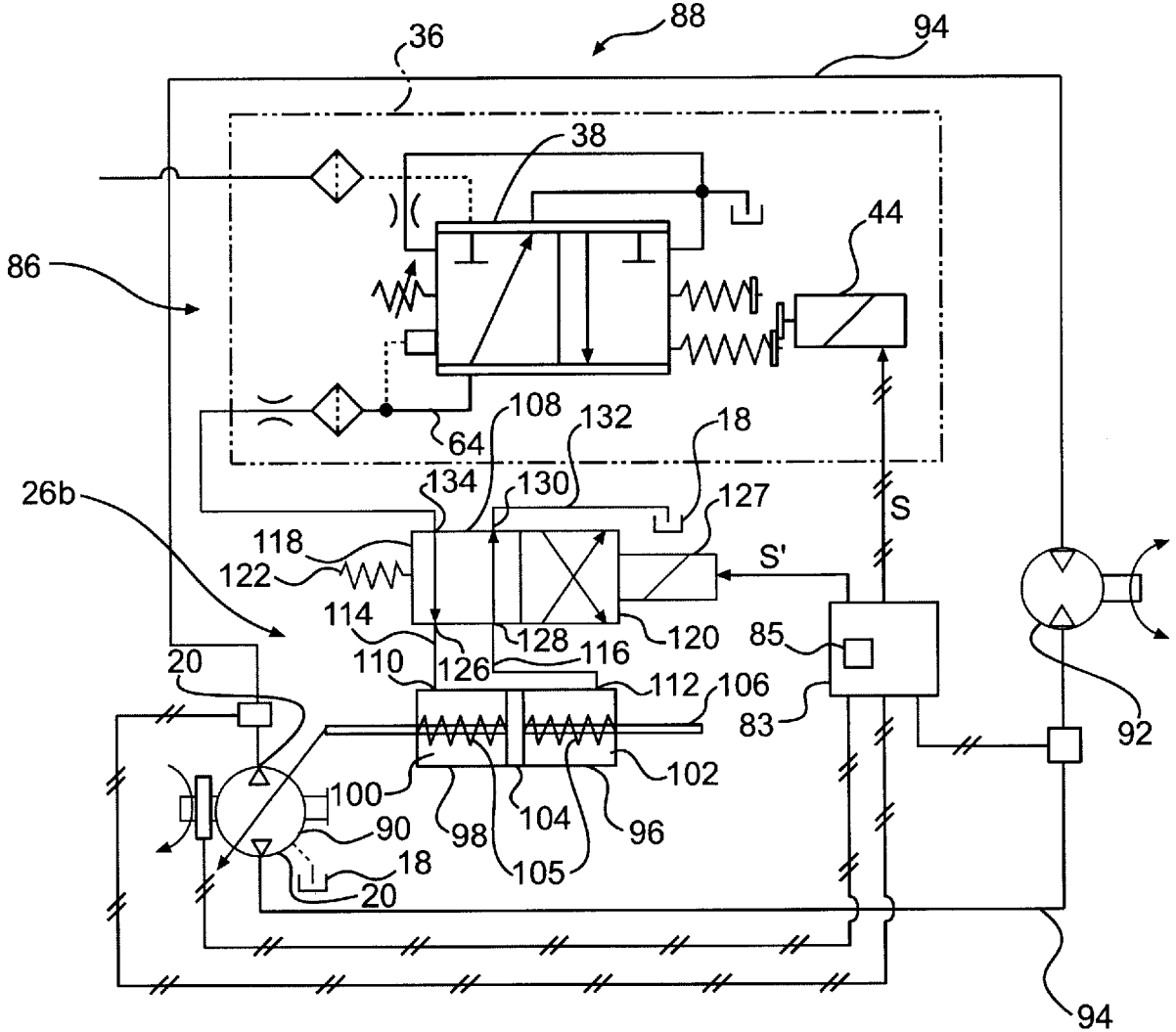
FIG. 2 illustrates a schematic and diagrammatic representation of an electro-hydraulic pump control system according to another embodiment of the present invention.

FIG. 2 illustrates another embodiment of the pump control arrangement according to the invention. The pump control arrangement 86 shown in FIG. 2 may be used in a closed-loop system 88 utilizing a variable displacement hydrostatic pump 90 to drive a hydrostatic motor 92 or the like. The hydrostatic pump 90 can interchangeably pump fluid in both forward and reverse directions by rotating the swashplate (not shown) in one direction or the opposite direction. This configuration is suitable to drive, for example, a drive train of a machine.

The pump 90 is connected to the hydrostatic motor 92 via a supply conduit 94 for driving the motor 92. The pump 90 is also connected to the reservoir 18 so that fluid may be supplemented into the system, if necessary. The pump 90 has two pressure outlet/inlet ports 20 connected to the supply conduit 94. The pressure outlet/inlet ports can interchange depending on the displacement direction of the pump 90. Similar to the pump 14 in the first embodiment, the pump 90 can vary its displacement between minimum and maximum displacement positions. By varying the displacement, the pump 90 can provide necessary fluid pressure to the hydrostatic motor 92 to achieve a desired motor speed.

The displacement of the pump 90 is controlled by another displacement changing mechanism 26*b* of the pump control arrangement 86. In the exemplary embodiment shown in FIG. 2, the displacement changing mechanism 26*b* includes an actuator 96 having a cylinder 98 divided into first and second chambers 100, 102 by a piston 104 biased by two centering springs 105. The first chamber 100 is connected to the conduit 114 via a first port 110, and the second chamber 102 is connected to the conduit 116 via a second port 112. The fluid can be introduced into or discharged out of each of chambers 100, 102. The piston 104 has an actuating rod 106 coupled to the pump 90 so that the displacement and pump direction of the pump 90 can be controlled by moving the piston 104.

The displacement changing mechanism 26*b* also has a four-way ON/OFF or proportional solenoid valve 108. In the disclosed embodiment, the proportional valve is a solenoid valve that can be actuated by an electrical signal "S'." The proportional valve 108 has a valve element (not shown in the figure) and first and second ends 118, 120. The proportional valve 108 also has a first port 126 connected to the conduit 114, a second port 128 connected to the conduit 116, a third port 130 connected to the reservoir 18 by a conduit 132, and a fourth port 134 connected to the three-way proportional valve 38 by the conduit 64.

The proportional valve 108 is movable between a first position and a second position. In the first position, the first port 126 is in fluid communication with the fourth port 134, and the second port 128 is in fluid communication with the third port 130. Thus, in the first position, the pressurized fluid from the three-way proportional valve 38 can travel to the first chamber 100 of the actuator 96 through the conduit 64, the proportional valve 108, and the conduit 114. At the same time, the fluid in the second chamber 102 of the actuator 96 escapes through the conduit 116, the proportional valve 108, and the conduit 132 to the reservoir 18. This results in displacement of the pump 90 in the forward direction.

Alternatively, the proportional valve 108 can be moved into a second position. In the second position, the first port 126 is in fluid communication with the third port 130, and the second port 128 is in fluid communication with the fourth port 134. Therefore, the pressurized fluid from the three-way proportional valve 38 travels through the conduit 64, the valve 108, and the conduit 116 into the second chamber 102 of the actuator 96. Simultaneously, the fluid in the first chamber 100 escapes out of the first chamber 100 through the conduit 114, the valve 108, and the conduit 132 to the reservoir 18. Consequently, the second position of the proportional valve 108 allows the actuator 96 to change the displacement of the pump 90 in the reverse direction.

The displacement changing mechanism 26*b* may include a spring biasing mechanism 122 disposed at the first end 118, which is operative to bias the proportional valve 108 towards the first position. The displacement changing mechanism 26 may also include a solenoid 127 disposed at the second end 120 of the proportional valve 108, which is operative to move the proportional valve 108 towards the second position. The valve 108 can also be activated mechanically or by any other suitable devices.

The pump control arrangement 86 shown in FIG. 2 also includes the pump control unit 83 having the memory 85. The pump control unit 83 is coupled to the proportional solenoid 44 and the solenoid 127 to provide the electrical signals S, S', respectively. The pump control arrangement 86 shown in FIG. 2 includes the same proportional solenoid valve arrangement 36 illustrated in FIG. 1A.

Figure 3:
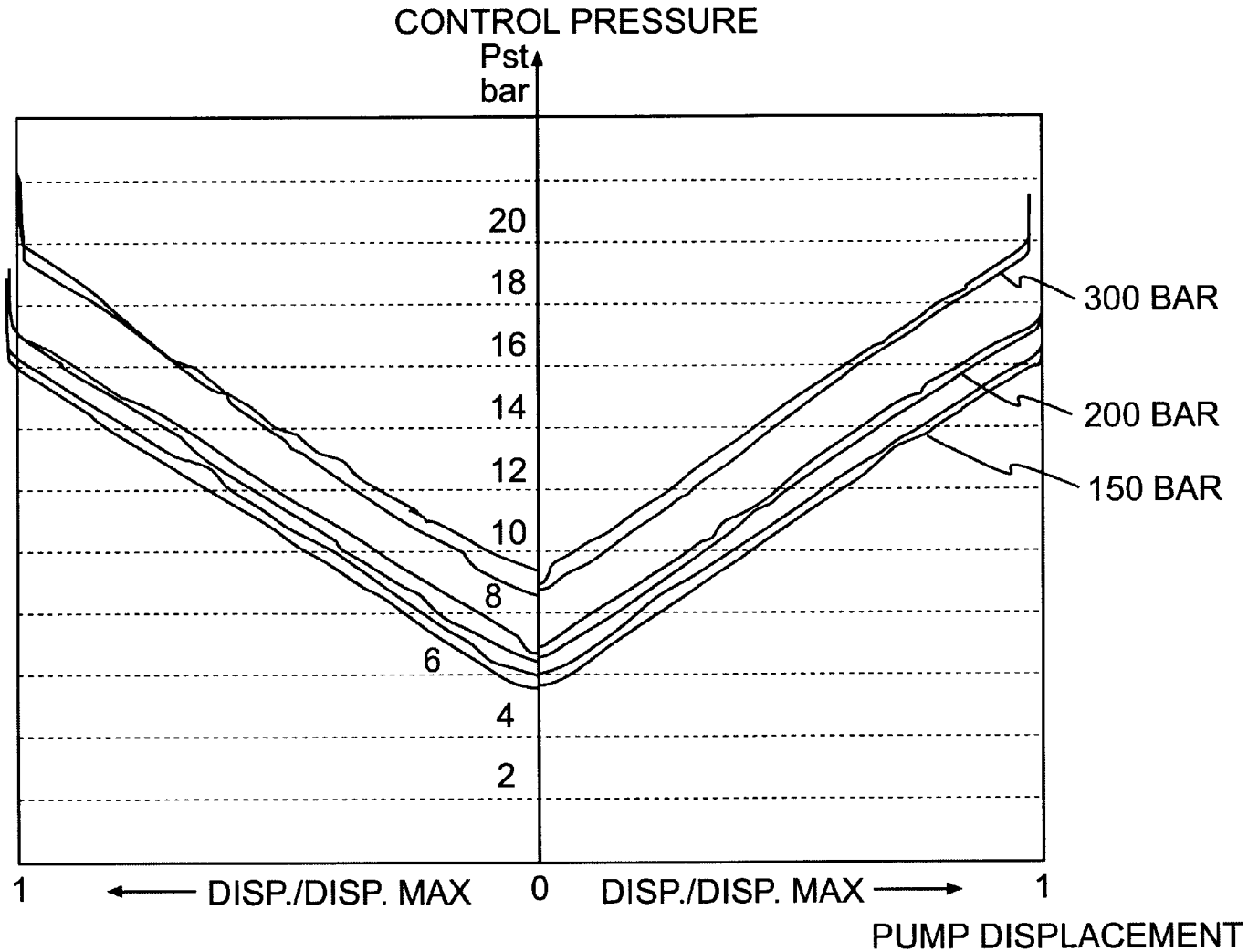
FIG. 3 is a graph illustrating the relationship between pump displacement and control pressure for different pump pressures.

FIG. 3 illustrates a graphical relationship between the electrical signal "S" to the proportional solenoid 44 and the pump displacement for the hydrostatic pump 14, 90 for different pump pressures. In the graph, pump displacement, normalized by the maximum pump displacement in forward and reverse pump directions, is plotted in the horizontal direction. The control pressure in bar is plotted in the vertical direction. The graph illustrates the measurement of the pump displacement verses control pressure for three exemplary pump pressures, namely 150, 200 and 300 bars. The graph shows values for both up stroke and down stroke for each pump pressure. As the signal increases, the pump displacement increases in either forward or reverse direction for the same pump pressure.

Figure 4:
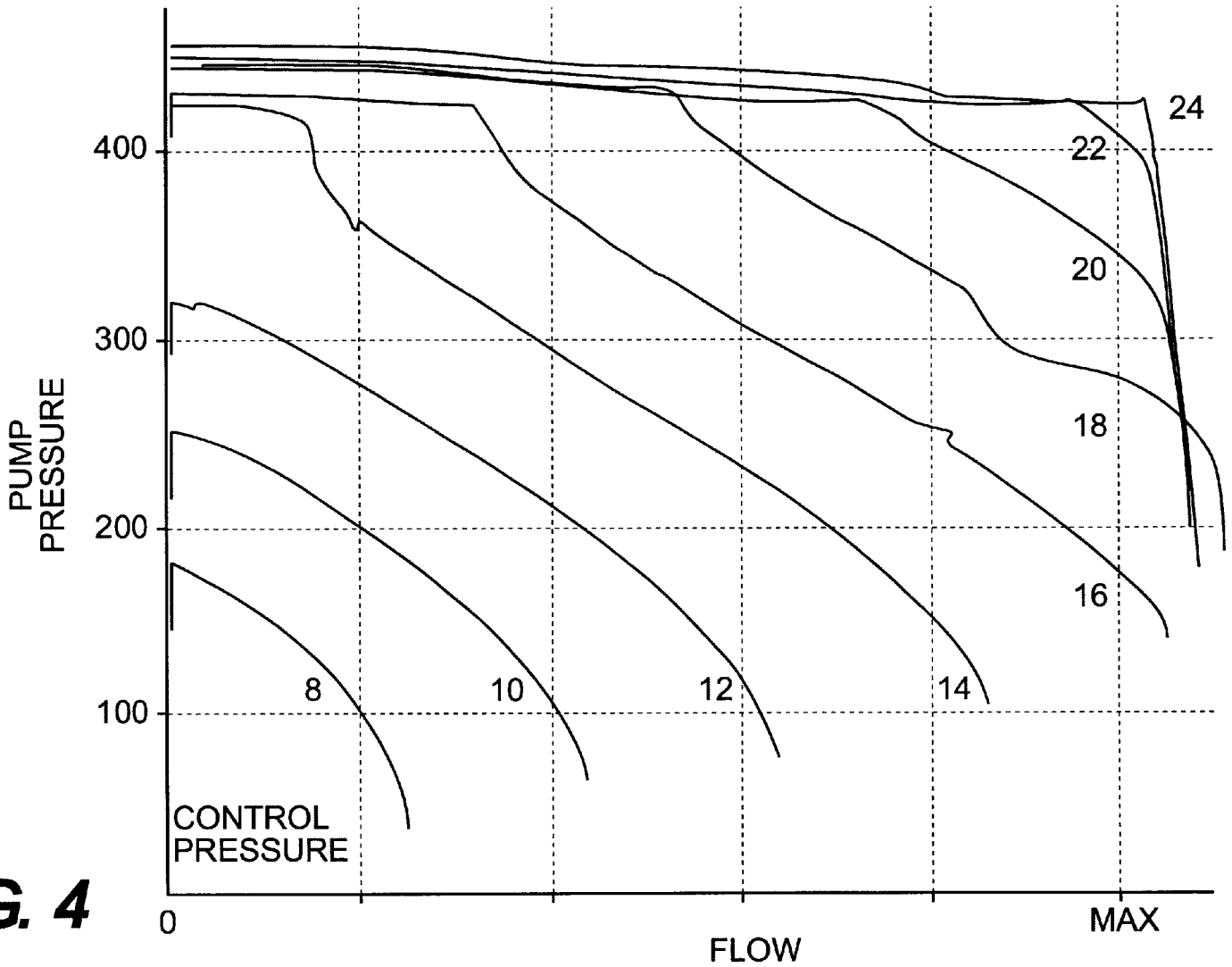
FIG. 4 is a graph illustrating the relationship between pump pressure and flow for different signal settings.

FIG. 4 illustrates the relationship between the pump pressure and the fluid flow at different signal settings. In the graph in FIG. 4, the fluid flow of the pump (from 0 to the maximum) is plotted in the horizontal direction. The pump pressure in bar is plotted in the vertical direction. This illustration is often called a "swivel map" of the pump. One skilled in the art can learn from the map the pump characteristics of a particular pump defined by features, such as pump displacement, pump discharge pressure, and pump torque limits. As the pump is used and suffers wear, the swivel map of the pump may change.

Figure 5A:
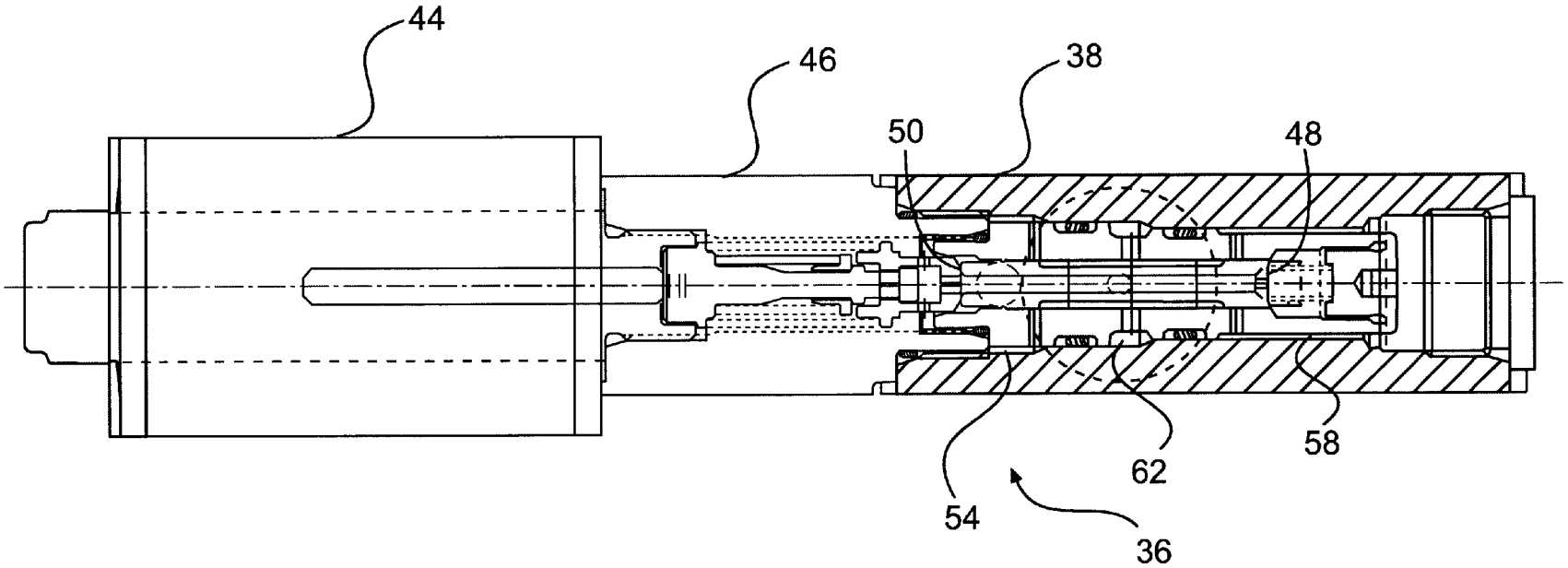
FIG. 5A is a cross-sectional view of a portion of the electro-hydraulic pump control system according to an embodiment of the present invention.
Figure 5B:
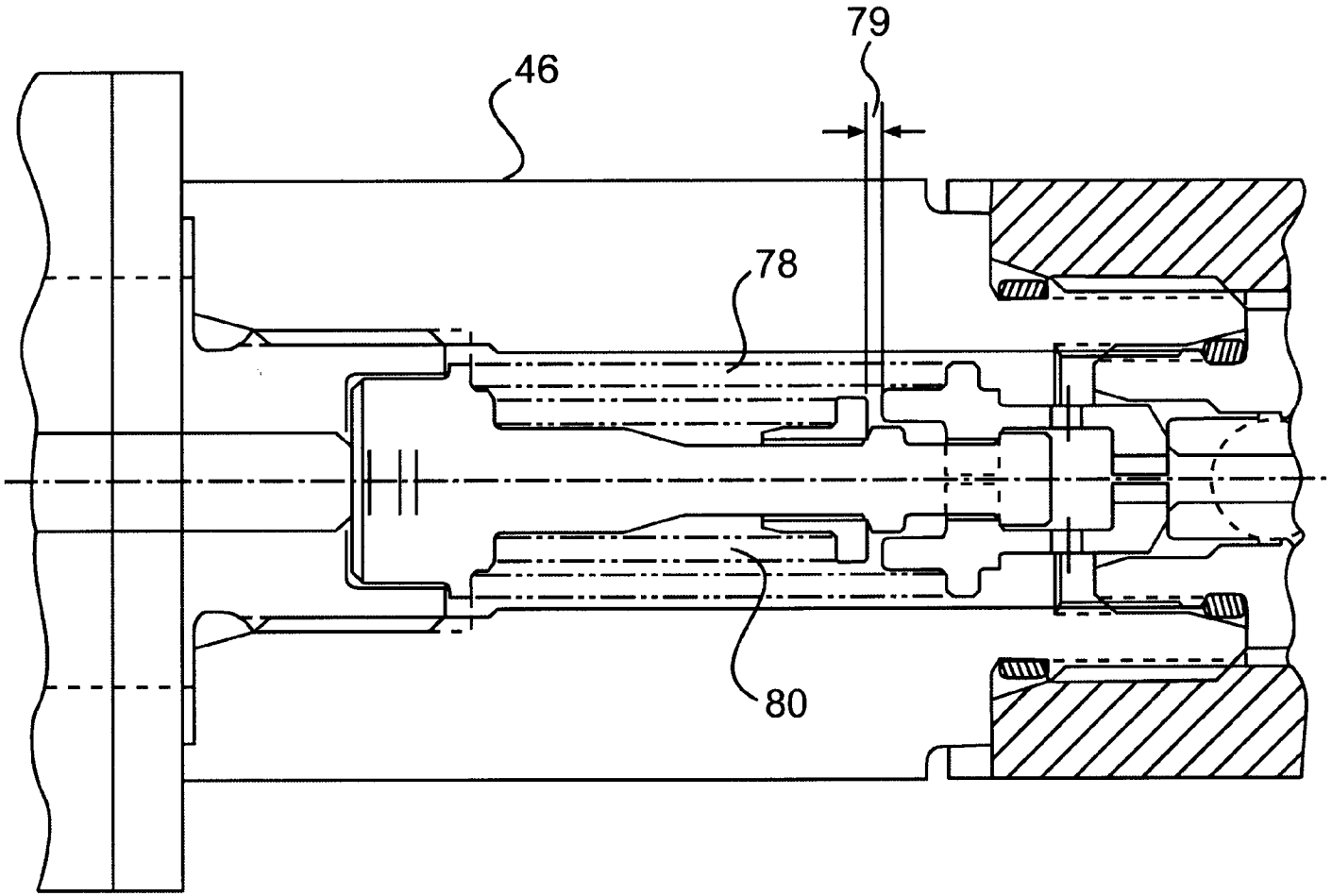
FIG. 5B is an enlarged view of a portion of the electro-hydraulic pump control system shown in FIG. 5A.
Figure 5C:
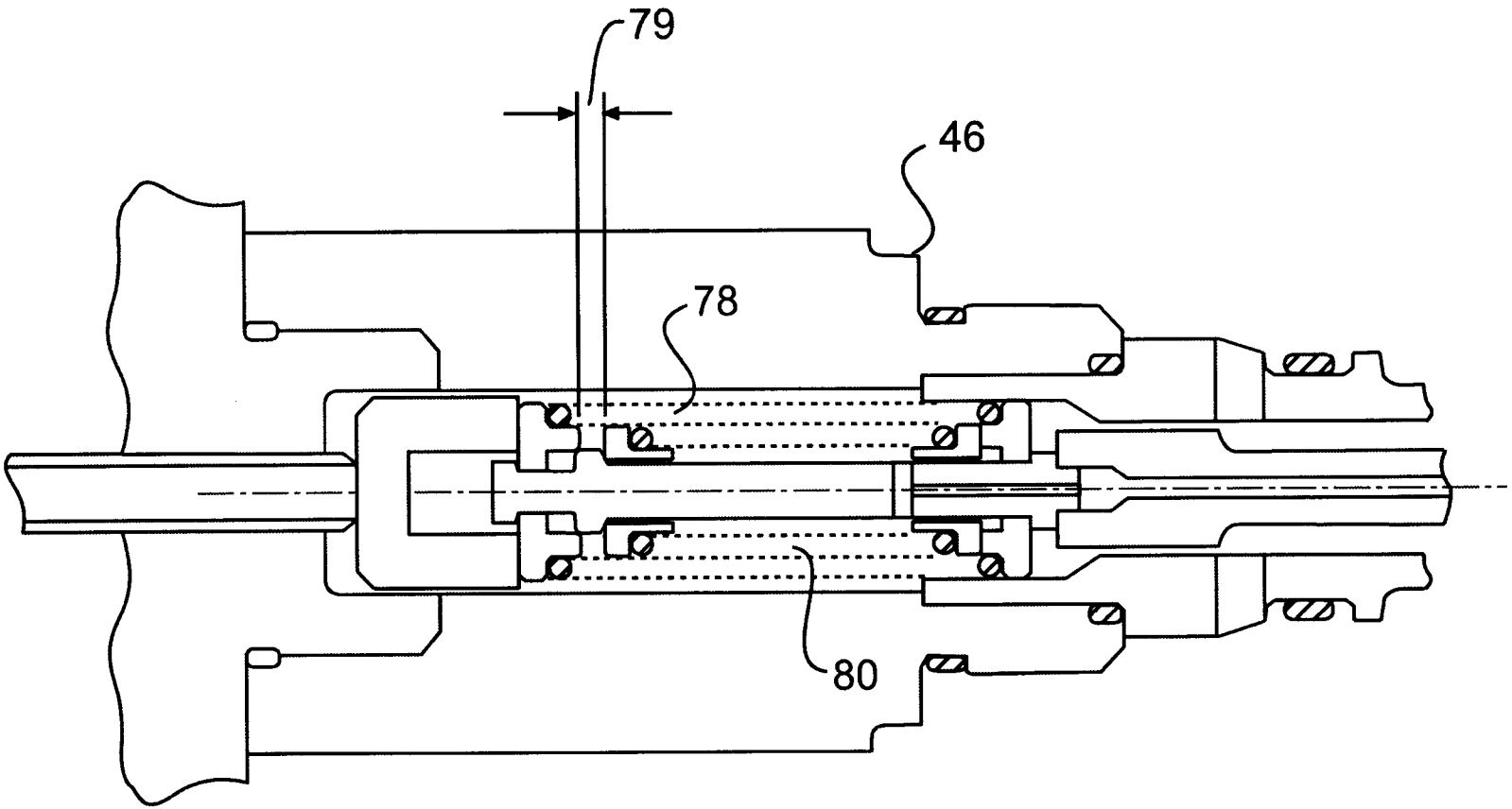
FIG. 5C is an enlarged view of a portion of the electro-hydraulic pump control system according to another embodiment of the present invention.

FIG. 5A illustrates one exemplary embodiment of the proportional solenoid valve arrangement 36. The proportional solenoid valve arrangement 36 has the three-way proportional valve 38, the proportional solenoid 44 and the captured spring assembly 46. The proportional solenoid valve arrangement 36 shown in FIG. 5A has the first end 48 and the second end 50 having larger diameter than the first end 48. Alternatively, the first end 48 and the second end 50 may have the same diameter, and the proportional solenoid valve arrangement 36 may be equipped with a bias piston. FIG. 5B shows the captured spring assembly 46 of the proportional solenoid valve arrangement 36 in detail. As shown in FIG. 5B, the captured spring assembly 46 has two springs 78, 80 disposed coaxially. The outer spring 78 is preloaded to define the minimum pressure setting and the inner spring 80 is preloaded to define the maximum pressure setting. FIG. 5C illustrates another exemplary embodiment of the proportional solenoid valve arrangement 36. FIG. 5C indicates the gap 79 between the outer spring 78 and the inner spring 80 of the captured spring assembly 46.

INDUSTRIAL APPLICABILITY

The operation of the open-loop system 10 illustrated in FIG. 1A is described hereafter. When the operation of the pump 14 is initiated without the electrical signal "S" to the proportional solenoid 44, pressurized fluid is directed from the pump 14 to the implement devices 12. The initial flow of the fluid from the pump 14 to the implement devices 12 starts to drive these implement devices. The resistance created by the implement devices 12 produces pressure in the supply conduit 22. At the initial startup of the pump 14, the spring 34 has the displacement changing mechanism 26*a* biased to the minimum displacement position. Because the spring biasing mechanism 42 of the proportional solenoid arrangement 36 has the proportional valve 38 in the first position, the pressure in the supply conduit 22 is blocked at the proportional valve 38. At this time, the pump 14 is operated at its minimum displacement because the pressurized fluid from the pump 14 does not flow through the proportional valve 38 to the displacement changing mechanism 26. As shown in FIG. 1C, the point "O" represents this stage of the pump operation.

To increase the pump displacement and the fluid pressure to the implement devices 12, the electrical signal "S" is applied to the proportional solenoid 44. The proportional solenoid 44 produces a force that is proportional to the electrical signal "S." The force is directed against the proportional valve 38 in opposition to the biasing force of the spring biasing mechanism 42. Before the force of the proportional solenoid 44 moves the proportional valve 38, it needs to overcome the biasing force of the spring biasing mechanism 42 and the spring 78 that is preloaded to define the minimum pressure setting. As shown in FIG. 1C, therefore, the control pressure of the proportional solenoid valve arrangement 36 does not initially increase with the amplitude increase of the electrical signal "S" to the proportional solenoid 44.

Once the force of the proportional solenoid 44 overcomes the biasing force of the spring biasing mechanism 42 and the spring 78, the control pressure of the proportional solenoid valve arrangement 36 increases to reach the minimum pressure setting at the point "MIN" indicated in FIG. 1C. As the electrical signal "S" from the pump control unit 83 increases from the "MIN" point, the force of the proportional solenoid 44 urges the proportional valve 38 towards its second position, and the pressurized fluid from the pump 14 starts to travel through the proportional valve 38 to the displacement changing mechanism 26, thus moving the displacement of the pump 14 toward the maximum displacement position.

As shown in FIG. 1C, the control pressure of the proportional solenoid valve arrangement 36 increases in response to the electrical signal "S" from the pump control unit 83 to the solenoid 44 in the operative range of the pump 14. There is a correlation between the control pressure and the amplitude of the electrical signal "S" in the operative range. Increasing the signal "S" to the proportional solenoid 44 results in more fluid being passed through the valve 38 and the displacement changing mechanisms 26*a* is further moved toward the maximum displacement position. Because the pressure of the fluid in the conduit 64 is also acting in the pressure chamber 40 of the proportional solenoid valve arrangement 36, once the solenoid 44 provides excessive force, the proportional valve 38 moves towards its first position blocking the fluid pressure from the conduit 60.

When the electrical signal "S" is further increased, the solenoid 44 finally contacts the spring 80 that is preloaded to define the maximum pressure setting, as indicated at the point "MAX" in FIG. 1C. Once the control pressure reaches the "MAX" point, it no longer increases in response to the further increase of the electrical signal "S" because the force of the solenoid 44 works against the preloaded biasing force of the spring 80 and the proportional valve 38 does not move. At this time, the displacement changing mechanism 26*a* operates the pump 14 at its maximum displacement. The preloaded biasing force of spring 80 may vary as desired.

The signal "S" sent to the solenoid may be determined for a particular pump by testing or operation of the pump. Such determination involves learning the inherent characteristics of the pump, which are affected by features, such as swivel forces, centering spring, and noise. As shown in FIG. 4, pump displacement, pump pressure, torque limits and other features that define pump characteristics of a particular pump can be determined by the testing or operation of the pump. These features may change over time. Once the pump characteristics are determined, the correlation between the pump displacement and the electrical signal "S" can also be determined, and an electrical signal "S" to achieve a desired pump displacement can be accurately calculated.

In the exemplary embodiment, the pump displacement is evaluated for different amplitudes of the signal "S" applied to the solenoid, and reference points for the pump displacement and signal are created. Once a sufficient number of the reference points are created, the signal necessary to achieve a desired pump displacement can be obtained by interpolation and stored in the memory.

To learn the characteristics of the pump 14, the pump 14 may be operated with the pump speed sensor 13, the pump pressure sensor 15, and the load pressure sensor 17 coupled to the pump control unit 83 during a test operation of the pump. During the test operation of the pump 14, the pump speed sensor 13, the pump pressure sensor 15 and the load pressure sensor 17 measure the speed of the pump 14, the fluid pressure at the outlet port 20 and the fluid pressure at the load 12, respectively. These measurements are sent to the pump control unit 83 to determine the pump characteristics of the pump 14. The pump characteristics may represent, for example, the relationship between the pump pressure and the fluid flow at different control pressures. These pump characteristics are stored in the memory 85 in the pump control unit 83. Based on the pump characteristics, the pump control unit 83 determines the relationship between the electrical signal to the proportional solenoid 44 and the pump displacement of the pump 14 provides a specific amplitude of the electrical signal "S" to the solenoid 44 to control the displacement of the pump 14. Because the characteristics of a pump may change as the pump wears, the above-described steps of learning the characteristics of the pump may be performed to replace the old data into the memory with new data as desired.

Also, the pump control unit 83 may monitor the pump displacement of the pump 14, the control pressure, the fluid temperature, and the pump r.p.m. (rotation per minute) to improve accuracy of the electrical signal S. Moreover, calibration limits for the pump displacement, the control pressure, the fluid temperature, and the pump r.p.m. may be predetermined, and the pump control unit 83 may compare actual measurements of the pump displacement, the control pressure, the fluid temperature, and the pump r.p.m. to their desired valves. When the actual measurements deviates from the desired value, the pump control unit 83 may provide a system service warning signal.

The operation of the closed-loop system 88 illustrated in FIG. 2 is described hereafter. A suitable pilot supply source is connected to the proportional solenoid valve arrangement 36. The operation of the proportional solenoid valve arrangement 36 is the same as described above for the open-loop system 10 and its explanation will not be repeated.

When the operation of the pump 90 is initiated without the electrical signal "S" to the proportional solenoid 44, the pressurized fluid is directed from the pump 90 to the hydrostatic motor 92. The initial flow of the fluid from the pump 90 to the hydrostatic motor 92 starts to drive the motor 92. The resistance created by the motor 92 produces pressure in the supply conduit 94. At the initial startup of the pump 90, the actuator 96 is biased to the minimum displacement position by springs 105, and the proportional valve 108 is based to the first position by the spring basing mechanism 122. At this time, the pump 90 is operated at the minimum displacement position in the forward direction.

As the electrical signal "S" from the pump control unit 83 to the solenoid 44 is increased, the pressurized fluid flows from the pump 90, the three-way proportional valve 38, and the four-way proportional valve 108 to the first chamber 100 of the actuator 96. The fluid in the second chamber 102 of the actuator 96 flows out toward the reservoir 18 through the valve 108, thus increasing the displacement of the pump 90 in the forward direction.

To reverse the direction of the pump 90, the control unit 83 sends out the electrical signal "S" to the solenoid 127 to move the four-way proportional valve 108 toward the second position. The pressurized fluid from the pump 90 then flows through the three-way proportional valve 38 and the four-way proportional valve 108 to the second chamber 102 of the actuator 96. The fluid in the first chamber 100 of the actuator 96 flows out to the reservoir 18 through the valve 108, thus reversing the direction of the pump 90.

Thus, the present invention provides a simplified system to accurately control displacement of a variable displacement pump. Moreover, the control displacement system is advantageous in that it is relatively simple and inexpensive to manufacture.

It will be apparent to those skilled in the art that various modifications and variations can be made in the electro-hydraulic pump control system of the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for controlling displacement of a variable displacement pump coupled to a load, the method comprising:

determining pump characteristics through operation of the variable displacement pump, the pump characteristics determination including establishing first and second reference settings of the pump characteristics, the first and second reference settings being control pressure settings associated with a proportional solenoid;

determining an electrical signal to be applied to the proportional solenoid for a desired pump displacement based on the determined pump characteristics;

providing the electrical signal to the proportional solenoid; and controlling the displacement of the variable displacement pump based on the electrical signal to the proportional solenoid the pump characteristics are determined by interpolation of the first and second reference settings.

2. The method of claim 1, wherein the first and second reference settings are maximum and minimum values of the control pressure settings.

3. The method of claim 1, further including storing the pump characteristics in a memory.

4. The method of claim 1, wherein the pump characteristics are determined by measuring pump speed, outlet pressure of the variable displacement pump, and pressure at the load.

5. A method for controlling displacement of a variable displacement pump coupled to a load, the method comprising:

applying an electrical signal of varying amplitude to a proportional solenoid during operation of the variable displacement pump;

evaluating displacement of the variable displacement pump for different amplitudes of the electrical signal to create reference points for the electrical signal and the pump displacement; and determining the electrical signal to be applied to the proportional solenoid for a desired pump displacement by interpolation of the reference points.

6. The method of claim 5, further including establishing maximum and minimum control pressure settings for the proportional solenoid.

7. The method of claim 5, wherein the step of evaluating pump displacement includes sensing pump speed, outlet pressure of the variable displacement pump, and pressure at the load for the electrical signal.

8. The method of claim 5, further including storing the reference points in a memory.

9. A fluid control system comprising:

a pump control unit;

a variable displacement pump in communication with the pump control unit;

a fluid displacement changing mechanism;

a valve arrangement fluidly connected to the variable displacement pump and operative to fluidly communicate with the displacement changing mechanism; and a solenoid configured to operate the valve arrangement in response to a control signal input to the solenoid, wherein a range of operation of the variable displacement pump is represented by the control signal based on predetermined system characteristics, the pump control unit being operative to update the control signal in response to the controller and at least one sensor sampling an operation condition, and wherein the predetermined system characteristics include first and second reference settings, and the control signal is determined by interpolation of the first and second reference settings.

10. The fluid control system of claim 9, wherein the fluid displacement change mechanism modifies displacement of the variable displacement pump in response to selective movement of the valve arrangement.

11. The fluid control system of claim 10, wherein the fluid displacement changing mechanism is coupled to the variable displacement pump.

12. The fluid control system of claim 9, wherein the valve arrangement comprises a valve configured to fluidly connect the displacement changing mechanism with a fluid reservoir and to fluidly disconnect the variable displacement pump with the displacement changing mechanism in a first valve position, the valve configured to fluidly connect the displacement changing mechanism with the variable displacement pump in a second valve position.

13. The fluid control system of claim 12, wherein the solenoid is operative to provide a variable force to move the valve between the first and second positions, the solenoid being actuated by an electrical signal determined based on the system characteristics.

* * * * *